US005933922A

United States Patent [19]

Ochsman

[11] Patent Number: 5,933,922

[45] Date of Patent: Aug. 10, 1999

[54] WEARABLE MULTI-PURPOSE CLAMP CARRYING A RING SUPPORT

[75] Inventor: Ralph Ochsman, Potomac, Md.

[73] Assignee: Drip Clip, Inc., Potomac, Md.

[21] Appl. No.: 09/066,846

[22] Filed: Apr. 28, 1998

[51] Int. Cl.[6] ..... A44B 21/00

[52] U.S. Cl. ..... 24/3.11; 24/346; 24/504

[58] Field of Search ..... 24/3.11, 3.7, 3.12, 24/3.4, 3.5, 3.3, 7, 8, 72.5, 72.1, 338, 324, 346, 343, 328, 331, 332, 170, 191, 192, 494, 497, 498, 499–502, 513, 515–517; 248/317

[56] References Cited

U.S. PATENT DOCUMENTS

| | | | |
|---|---|---|---|
| 187,649 | 2/1877 | Lewis et al. . | |
| 202,202 | 4/1878 | Thompson . | |
| 251,853 | 1/1882 | Ewing | 24/346 X |
| 262,710 | 8/1882 | Todd et al. | 24/346 X |
| 264,879 | 9/1882 | Hugill . | |
| 501,332 | 7/1893 | Drevet . | |
| 541,384 | 6/1895 | Pascoe | 24/346 X |
| 655,069 | 7/1900 | Frame . | |
| 1,864,281 | 6/1932 | Short . | |
| 1,962,186 | 6/1934 | Finkbeiner | 24/516 X |
| 2,104,955 | 1/1938 | Stark | 24/504 |
| 2,247,372 | 7/1941 | Hart . | |
| 2,287,717 | 6/1942 | Barnes . | |
| 4,005,510 | 2/1977 | Noda | 24/504 |
| 4,084,299 | 4/1978 | Noda | 24/504 |
| 4,157,166 | 6/1979 | Voelker | 24/36 X |
| 4,463,482 | 8/1984 | Hawie | 24/517 S |
| 5,085,060 | 2/1992 | Matsushita | 24/507 X |
| 5,235,730 | 8/1993 | Townsend | 24/3.12 X |

FOREIGN PATENT DOCUMENTS 14695 10/1881 Germany .

OTHER PUBLICATIONS

Unknown Catalog p. 87, received Apr. 24, 1998.

*Primary Examiner*—James R. Brittain
*Assistant Examiner*—Robert J. Sandy

[57] ABSTRACT

A wearable multi-purpose clamp includes a substantially planar base hingedly connected to a movable jaw and carries a spring clip, an L-shaped lever and a ring support. The base, movable jaw and L-shaped lever together bear a loose resemblance to a clamp for use with suspenders (e.g., for attachment to the waist band of the pants). The base includes a base jaw, a base central aperture and has first and second opposing perpendicular journal tabs, each with a coaxial journal hole therethrough. The base also preferably includes first and second elongate raised salient features which are disposed substantially parallel to the base sidewalls and to one another and are spaced apart by a selected spacing defining a groove or trough therebetween. The movable jaw also includes teeth, spring center tabs received in the base central aperture, and first and second oppositely projecting side tabs disposed between the upwardly projecting base wall and base journals to provide a spring biasing force (in cooperation with a biasing force provided by the center tabs) tending to force the movable jaw into an open position. The clamp jaws are therefore adapted grasp and hold a napkin or other flexible substrate. The L-shaped lever includes a substantially planar front cover having an aperture therethrough and carrying the ring support. The ring support has first and second chamfered ends biased closed and partially overlapping to define an open loop. The multi-purpose clamp is readily adapted to conveniently carry keys and eyeglasses, among other things.

14 Claims, 6 Drawing Sheets

USA

WEARABLE MULTI-PURPOSE CLAMP CARRYING A RING SUPPORT

BACKGROUND OF THE INVENTION

1. Field of the Invention

The present invention relates to jewelry and clothing accessories, and more particularly, multi-use wearable accessories for supporting a napkin or other flexible substrate in position to provide a protective cover over the clothes, and including a support for holding eye-glasses, keys, or other personal effects.

2. Discussion of the Prior Art

Diners have soiled and stained shirts, ties, blouses and dresses while dining.

Both children and adults are sometimes prone to spilling sauces or soups and dropping morsels of food onto their clothing, possibly ruining a favorite garment.

As a result, children are often forced to wear bibs covering part or all of the front torso, and may struggle to avoid having a bib tied around the neck. Gentlemen and ladies may sometimes stoop to wearing a bib, especially at bar-b-ques, crab feasts or the like, but never when engaged in fine dining in a restaurant. Aside from connotations of childishness, bibs are unacceptable to most diners because they are often just gauche sheets of plastic tied about the neck, are uncomfortable against the throat, and seldom compliment one's wardrobe. As a result, most diners will not wear a bib when dining out and so may be forced to forgo a much-desired but possibly messy lobster dinner, to cite but one example.

Children will sometimes take a napkin from the table and stuff or tuck a portion of the napkin down behind a tightly buttoned collar. While expedient, this solution is also not acceptable for a fine dining experience and is not likely to garner favor among gentle people in a diner's company. Both of the above mentioned activities (i.e., wearing a bib and stuffing a napkin in one's shirt collar) seem to suggest to the onlooker that the diner's appearance does not matter and that the diner is about to throw caution to the wind, engaging in a bacchanalian orgy of eating and drinking, with food and drink likely flying about. A diner who merely wishes to keep his or her clothes unstained surely has no desire to convey such an impression.

In the prior art, others have attempted to meet this unresolved need by providing napkin holders for carrying a napkin worn on the diner's front and hung from a button.

The various prior art napkin holders have failed to gain widespread acceptance, however, because of difficulty in use, unsightly appearance, strain placed on buttons, the requirement that the wearer have a shirt or blouse with buttons, and other shortcomings.

Eyeglass wearers are often confronted with a need for a quick and handy place to temporarily keep eyeglasses when dining or when the hands are otherwise occupied with the task at hand. When driving, for example, an eyeglass wearer cannot divert his or her attention from the road ahead to find an eyeglass case and may not have a pocket available.

Users of keys may not want to keep a key with many other keys on a key fob buried in a pocket or purse. A lady's office restroom key, for example, may be kept at a desk or workstation and must not be lost, during use. Thus, keeping a key on a separate key fob may prove unsuitable, since the key may not fall readily to hand when urgently needed and may be easily misplaced if set down in the restroom.

There has been a long felt need, then, for a wearable and attractive multi-purpose holder permitting the user to easily and effectively protect his or her clothing, support his or her glasses, and/or take along a valuable key, as needed, without requiring the user to bring several different devices for these apparently diverse purposes.

OBJECTS AND SUMMARY OF THE INVENTION

It is an object of the present invention to overcome the shortcomings of the prior art.

It is also an object to provide a single device permitting the user to wear, retain and/or clamp a wide variety of personal effects onto his or her person, as needs dictate.

Another object is providing a wearable, stylish apparatus for attaching or draping a napkin to cover a diner's front torso area.

Yet another object is providing convenience and flexibility in how and where a user hangs, suspends or attaches a napkin and/or a pair of eyeglasses onto the user's front.

The aforesaid objects are achieved individually and in combination, and it is not intended that the present invention be construed as requiring two or more of the objects to be combined unless expressly required by the claims attached hereto.

In accordance with the present invention, a wearable napkin holding clamp with integral ring support includes a substantially planar base hingedly connected to a movable jaw and carries an L-shaped lever and a spring clip. The base, movable jaw and L-shaped lever together bear a loose resemblance to a clamp for use with suspenders (e.g., for attachment to the waist band of the pants). The base includes a base jaw with jaw teeth or serrations on a first end opposing a second end having a perpendicular base wall. The base also includes a base central aperture proximate the base wall and has first and second opposing perpendicular journal tabs, each with a journal hole therethrough. The base also preferably includes first and second elongate raised salient features which are disposed substantially parallel to the base sidewalls and to one another and are spaced apart by a selected spacing defining a groove or trough therebetween.

The movable jaw also includes teeth or serrations adapted to cooperatively close to a closed position proximate to (but slightly offset from) the base jaw teeth. The movable jaw also includes spring center tabs which are received in the base central aperture. The movable jaw also includes first and second oppositely projecting side tabs which are disposed between the upwardly projecting base wall and base journals to provide a spring biasing force (in cooperation with a biasing force provided by the center tabs) tending to force the movable jaw into an open position. The movable jaw also includes a camming surface disposed substantially between the base projecting journal tabs.

The L-shaped lever includes a substantially planar front cover with an aperture therethrough for carrying the integral ring support and attached at one end to a substantially perpendicular camming lever arm having, on opposite sides, first and second axial tabs sized to be received in the coaxially aligned opposing base journal tab holes. The lever planar front cover has an outer surface optionally bearing an ornamental design, the design is preferably stamped or molded into the planar front cover and can be seen on the front cover inner surface (opposite the outer surface).

The ring support is preferably fabricated from spring steel and comprises a contiguous curved loop passing through the front cover aperture and hanging loosely therefrom. The ring support has first and second chamfered free ends biased into overlapping contact and forming a loop opening which may be pried apart to insert a key having a key-ring aperture therethrough. The ring support is preferably curved into an upper half circle section of a smaller radius disposed in a first plane and passing through the front cover aperture at a right angle thereto; the upper half circle section is connected via first and second contiguous bent sections with a lower larger ring section having a radius approximately three times the size of the upper half circle section radius. The lower ring section is disposed in a plane transverse to the plane of the upper half circle section and is preferably indented with notches on the front and back exterior surfaces.

The spring clip is preferably fabricated from spring steel wire or the like and, in a first embodiment, includes a number of compound curves and bends forming an elongate narrow clip arm terminating in a clip arm distal end. The spring clip also includes first and second yoke members bent back at an acute angle and formed in a shallow arcuate curve; the distal ends are received in a notch between the base wall the base journal tabs. The spring clip yoke members exert a spring force tending to bias the clip yoke distal ends against the inner surfaces of the first and second base projecting journals and provide an orienting force for the spring clip, biasing the clip arm into close proximity with the back surface of the base; the clip arm is thereby disposed intermediate the first and second base elongate salient features. Preferably, as noted above, the base salient features provide a trough or a groove therebetween into which the clip arm rests, thereby providing additional friction on a napkin or substrate (e.g., fabric, webbing or the like) which is interposed between the clip arm and the base back surface.

In an alternative embodiment, the clip arm is relatively shorter, extending from an upper apex downwardly toward the clamp back for a clamp arm length of approximately one centimeter.

The napkin holding clamp may be opened by grasping the base and rotating the lever about the axis of the journal tab holes, thereby allowing the spring force biasing the movable jaw to force the movable jaw and the base apart. To close the clamp, one grasps the planar front cover and rotates it about the axis of the journal holes, toward the base jaw, so the camming lever arm is brought downwardly to bear on the movable jaw camming surface, thereby forcing the movable jaw teeth into close proximity with the base jaw teeth. Once the planar front cover is in the fully closed position, the spring bias force of the movable jaw tends to push upwardly against the camming lever arm, thereby keeping napkin holding clamp 10 biased in the closed position.

When the diner or user wishes to use the napkin holding clamp, the user finds a suitable button hole and, while grasping the napkin holding clamp by either the base or front cover, the clip arm distal end is maneuvered through the open button hole and the napkin holding clamp is then further inserted such that the selected button hole is slidably brought into close proximity with the hilt of the clip arm (at the first and second sliding clip yoke members).

The spring clip yoke members are bent to leave a gap or spacing (e.g., two 5 millimeters (mm)) therebetween; the gap defines the spacing between the wire segments making up the clip arm. The clip arm width is selected to permit the clip arm to lie in-line with the long axis of the button hole, without straining or tearing the button hole stitching. The gap between first and second yoke members (e.g., two mm) is also sufficiently wide to allow a standard shirt button (having a thickness of two mm) to pass therethrough, allowing the user to replace the shirt button in the button hole after the napkin holding clamp has been inserted into and suspended from the button hole.

Once the napkin holding clamp has been suspended from or is supported by the button hole, the user may then grasp the planar front cover, opening the jaws, whereupon a napkin or other protective cloth or cover may be inserted between the jaws. The user then simply grasps the planar front cover and closes the jaws as discussed above, thereby firmly clamping and grasping the napkin.

For users having no suitably located button holes such as those wearing crewneck sweaters or the like, the user may simply grasp the napkin holding clamp by the planar front cover or base and insert the collar fabric in between the clip arm distal end and the base, advancing the collar fabric toward the clip arm hilt at the first and second yoke members, thereby securely suspending the napkin holding clamp from the collar.

Users wishing to protect a neck-tie can suspend the napkin holding clamp by the clip arm. The clip arm distal end is inserted in the upward facing horizontal seam as found on a neck tie tied in the Windsor style. The napkin holding clamp is then slidably moved downwardly to permit the clip arm hilt to rest upon the horizontal segment of the neck tie, at the top and center of the Windsor knot (to cite but a single example).

Alternatively, a user may hang the clamp from a button hole, as described above, and may then insert the temple-piece of his or her eyeglasses through the integral ring support.

The base, movable jaw, L-shaped lever, integral ring support and spring clip may be made from carbon steel, stainless steel, aluminum, gold, silver, platinum, plastic, or any combination thereof, as the intended market and use dictate. The napkin holding clamp can be given to diners as promotional items bearing an advertising logo or may be made of a precious metal for sale in fine jewelry stores. The napkin holding clamp can also be packaged for presentation with a napkin or scarf, optionally including indicia matching indicia on the clamp front cover (e.g., for school colors or the like).

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

DESCRIPTION OF THE PREFERRED EMBODIMENT

Figures 1, 2, 3, 4:
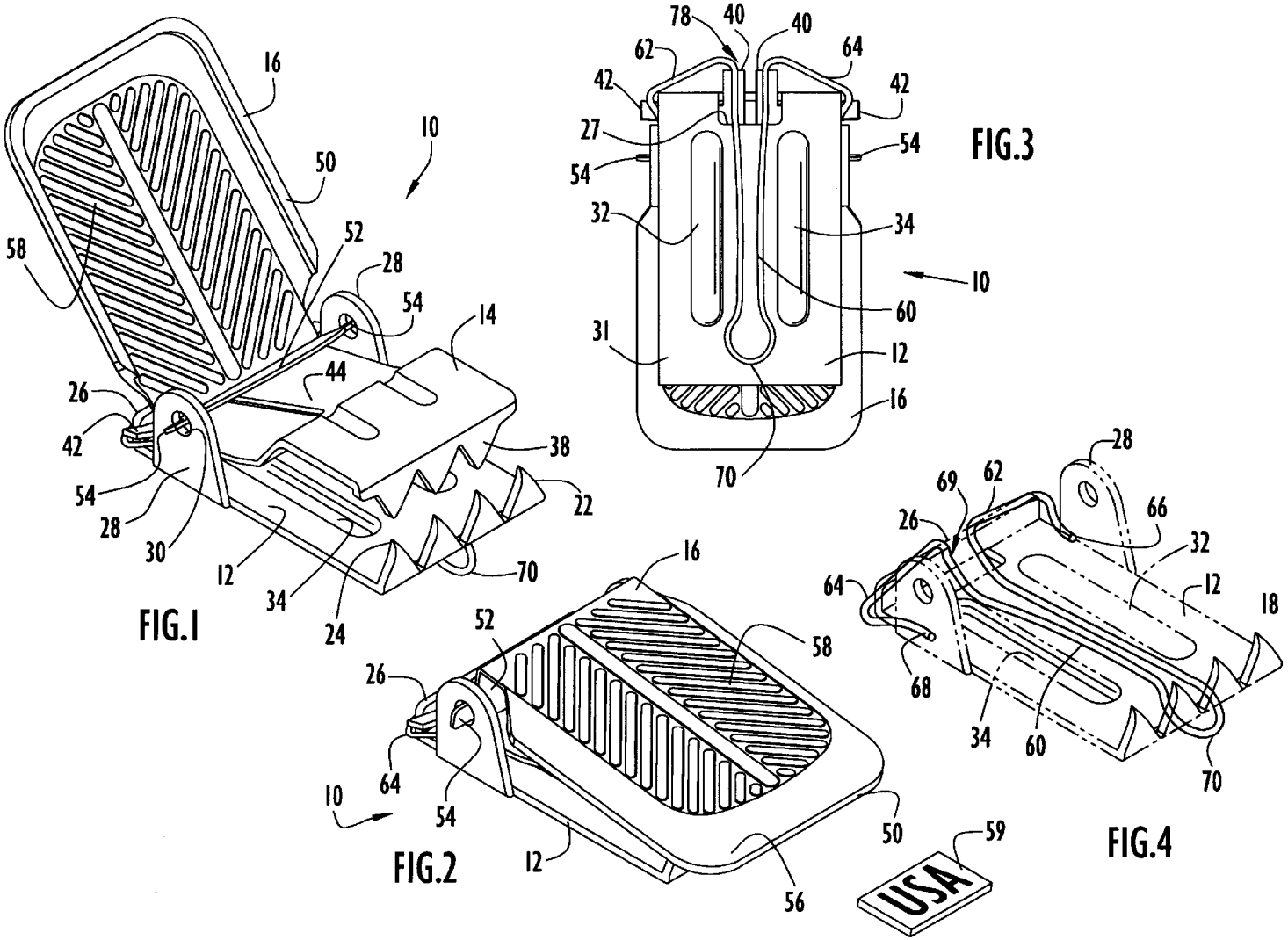
FIG. 1 is a perspective view of a napkin holding clamp in the open position.
FIG. 2 is a perspective view of the napkin holding clamp of FIG. 1, in the closed position.
FIG. 3 is a rear view, in elevation, of the napkin holding clamp of FIG. 2.
FIG. 4 is a perspective view of the napkin holding clamp spring clip shown with a phantom representation of the napkin holding clamp base.

Referring specifically to FIGS. 1, 2, 3 and 4 of the accompanying drawings, a wearable clamp 10 is illustrated in the open position; clamp 10 is well suited to grasp and hold a napkin (or other flexible substrate) and so will, for purposes of nomenclature, be identified as a napkin holding clamp. Napkin holding clamp 10 includes a substantially planar base 12 hingedly connected to a movable jaw 14 and carrying an actuator or L-shaped lever 16 and a spring clip 18. Base 12 includes a base jaw 22 having a plurality of jaw teeth or serrations 24 opposing (along the long dimension of base 12) a perpendicular base wall 26 (best seen in the phantom view of FIG. 4). Base 12 includes a base central aperture 27 proximate base wall 26 and has first and second opposing base projecting journals 28 which are preferably formed as perpendicular tabs, each including a journal hole 30. Viewed from the back side 31 or rear, as shown in FIG. 3, Base 12 also preferably includes first and second elongate salients 32, 34 which are disposed substantially parallel to the base sidewalls and to one another and are spaced apart by a selected spacing, defining a trough, recess or groove therebetween.

Movable jaw 14 also includes teeth or serrations 38 adapted to cooperatively close in an offset shearing motion into close proximity with base jaw teeth 24. Movable jaw 14 also includes bendable, spring-like center tabs 40 which are adapted to be received in base central aperture 27. Movable jaw 14 also includes first and second side tabs 42 which are disposed in a notch defined between the upwardly projecting base wall 26 and base projecting journals 28 to provide a spring biasing force (in cooperation with a biasing force provided by the center tabs 40) tending to force movable jaw 14 into the opened position (as shown in FIG. 1). Movable jaw 14 also includes a camming surface 44 disposed substantially between the base projecting journals 28.

L-shaped lever 16 includes a substantially planar front cover 50 attached at one end to a substantially perpendicular camming lever arm 52 having, on opposite sides, first and second axial tabs 54 which are sized appropriately to be received in the coaxially aligned base projecting holes 30, as shown in FIGS. 1 and 2, thereby defining a hinge having an axis of rotation. The lever planar front cover 50 has an outer surface 56 (as shown in FIG. 2) bearing an ornamental design 58 which is preferably stamped or molded into planar front cover 50 and so the design can be seen on the front cover inner surface opposing outer surface 56 (as shown in FIG. 1). Optionally, a placard 59 may be bonded onto outer surface 56 for display of any selected symbols, indicia or logo (e.g., "USA", as shown in FIG. 2).

Spring clip 18 is preferably fabricated from a contiguous length of spring steel wire or the like and includes a number of compound curves and bends, as shown in FIG. 4, forming an elongate narrow clip arm 60 terminating in a clip arm free distal end 70. Spring clip 18 also includes a first yoke member 62 symmetrically opposing a second yoke member 64 where first yoke member is terminated in a first yoke member distal end 66 and second yoke member 64 is terminated in a second yoke member distal end 68. The yoke members of spring clip 18 are bent back at an acute angle leaving a gap 69 therebetween and then are formed in a shallow arcuate curve and are thereby adapted to be received in the notch or groove between base wall 26 and the base projecting journals 28, as shown (in phantom) in FIG. 4. Spring clip yoke members 62 and 64 thereby exert a spring force tending to bias the distal ends against the inner surfaces of the first and second base projecting journals 28 and provide an orientation for spring clip 18 tending to bias clip arm 60 into close proximity with the surface of base 12, intermediate the first and second base elongate salients 32, 34. Preferably, the base salients 32 and 34 provide a trough or a groove therebetween into which clip arm 60 rests, thereby providing additional friction on any fabric, webbing or the like which is interposed between clip arm 60 and base 12.

The napkin holding clamp 10 may be opened by grasping base 12 and rotating lever 16 about the axis of journal holes 30, thereby allowing the spring force biasing movable jaw 14 into the open position to force the movable jaw and the base apart, as shown in FIG. 1. By grasping planar front cover 50 and rotating it about the axis of holes 30 toward base jaw 22, camming lever arm 52 is brought downwardly to bear on movable jaw camming surface 44, thereby forcing movable jaw teeth 38 into close proximity of base jaw 22. As shown in FIG. 2, once the planar front cover is in the fully closed position camming lever arm 52 is past perpendicular with respect to camming surface 44 and the spring bias force of movable jaw 14 tends to push upwardly against the (now) angled camming lever arm 52, thereby keeping napkin holding clamp 10 biased in the closed position.

Figure 14:
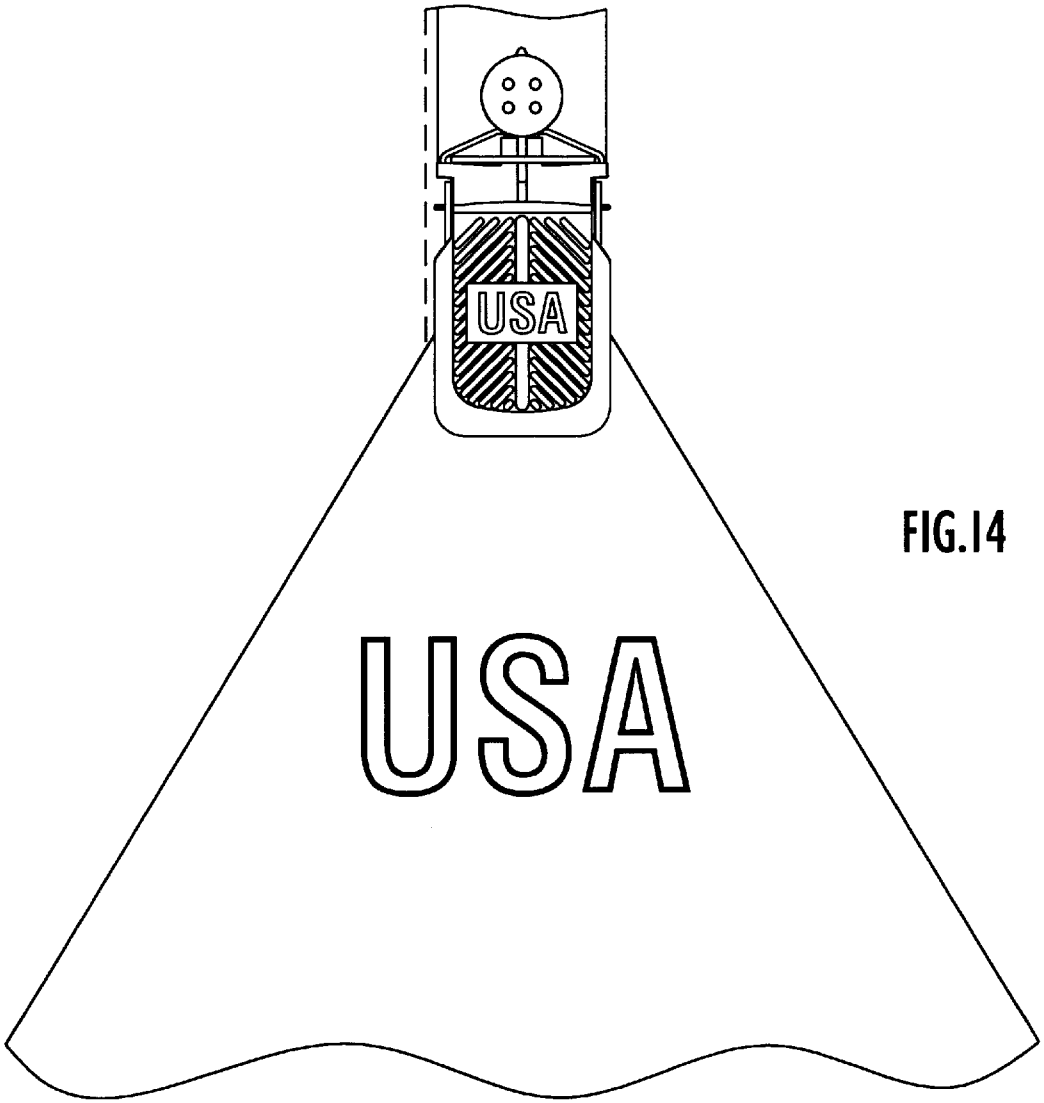
FIG. 14, shows, in elevation, a napkin holding clamp and placard carrying a napkin or scarf including indicia matching the placard indicia.

Base 12, movable jaw 14, L-shaped lever 16, and spring clip 18 are preferably made from carbon steel, stainless steel, aluminum, gold, silver, platinum, plastic, or any combination thereof, as the intended market and use dictate. Napkin holding clamp 10 can be offered to diners as a promotional item bearing an advertising logo or may be made of a precious metal for sale in fine jewelry stores. The napkin holding clamp 10 can also be packaged for presentation with a napkin 80 or scarf, optionally including indicia matching the indicia on placard 59 bonded to clamp front cover 50 (e.g., for school colors or the like) as shown in FIG. 14.

Figure 6:
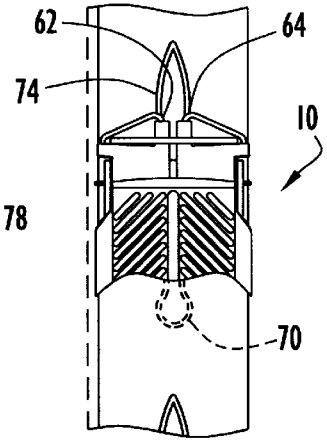
FIG. 6 shows, in elevation, the napkin holding clamp of the present invention suspended from a button hole.
Figure 5:
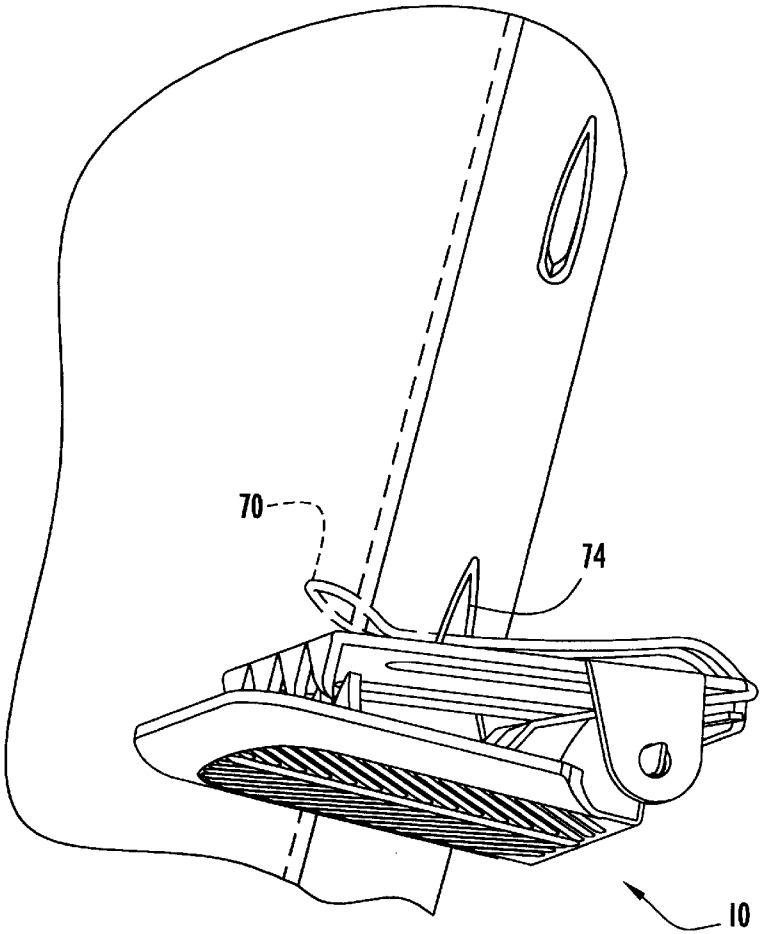
FIG. 5 is a perspective illustration of use of the napkin holding clamp of FIG. 1 and shows the method step of inserting the clip arm distal end through a button hole.
Figure 8:
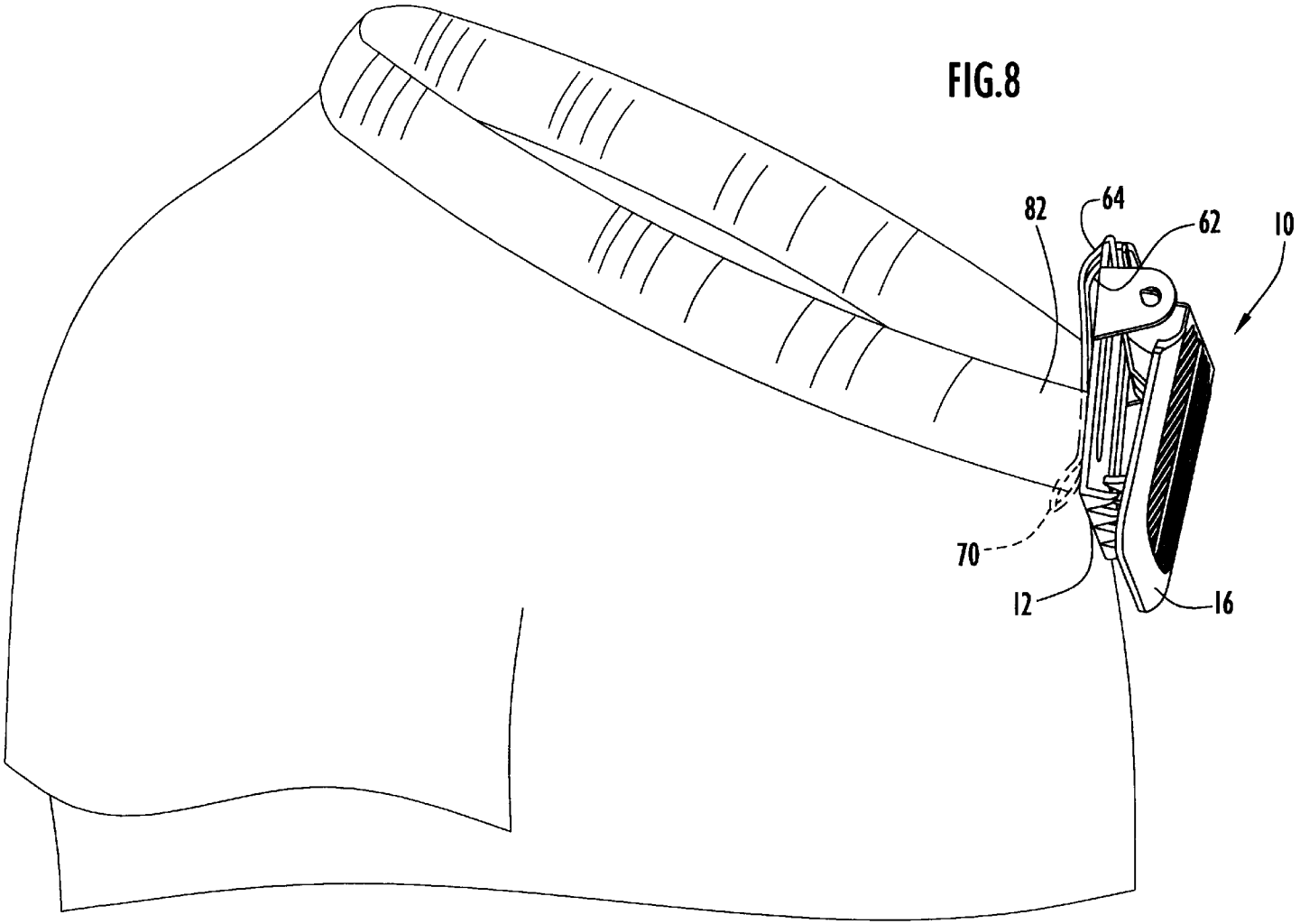
FIG. 8 illustrates, in perspective, the napkin holding clamp inserted over a crewneck collar.

When the user desires to use napkin holding clamp 10, a suitably located button hole (such as 74, shown in FIG. 5) is found and, while grasping the napkin holding clamp 10 by either base 12 or front cover 50, the clip arm distal end 70 is maneuvered through the open button hole 74. The napkin holding clamp 10 is then translated or further inserted such that the selected button hole 74 is slidably brought to the hilt of the clip arm 60, into close proximity with first and second sliding clip yoke members 62, 64, as shown in FIG. 6.

Figure 7:
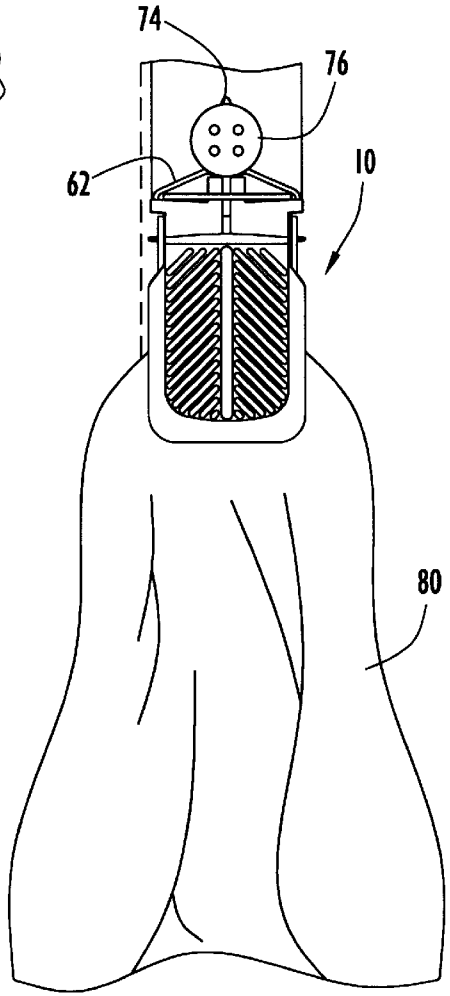
FIG. 7 illustrates the napkin holding clamp of FIG. 6 suspended in the button hole and supporting a napkin.

As noted above, yoke members 62 and 64 are bent to form clip arm 60 leaving a small gap (e.g., two mm) sized sufficiently small to allow clip arm 60 to lie in-line with the long axis of button hole 74. The gap between first and second yoke members 62, 64 (e.g., two mm) is also sufficiently wide to allow a standard shirt button having a thickness of two mm (e.g., button 76 as shown in FIG. 7) to pass therethrough allowing the user to replace button 76 in button hole 74 after napkin holding clamp 10 has been inserted into and suspended from button hole 74.

Once napkin holding clamp 10 has been suspended from or is supported by button hole 74, the user may then grasp a planar front cover 50 thereby opening jaws 14, 22 whereupon a napkin 80 or other protective cloth, substrate or cover may be inserted between the jaws. The user then simply grasps planar front cover 50 and closes jaws 14, 22 as discussed above, thereby firmly clamping and grasping napkin 80.

For users wearing garments having turtleneck, cowl-neck or crew-neck collars such as sweaters, T-shirts, sweatshirts or the like, the user may simply grasp napkin holding clamp 10 by planar front cover 50 or base 12 and insert the collar top edge 82 in between the clip arm distal end 70 and base 12, advancing the collar top edge 82 toward the clip arm hilt 78 or apex defined by first and second yoke members 62, 64 thereby securely suspending napkin holding clamp 10 from the collar.

Figure 9:
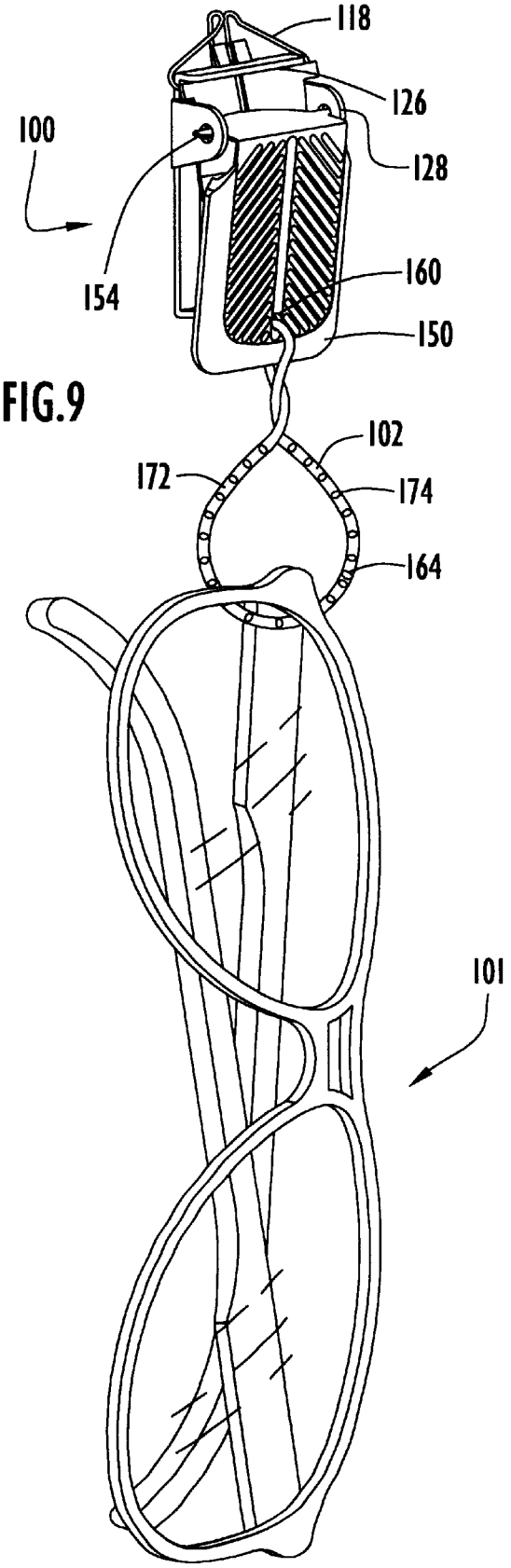
FIG. 9 shows, in perspective, a multi-purpose clamp in the closed position, with eyeglasses supported on the integral support ring.

As shown in FIG. 9, users wishing to protect a neck-tie can suspend the napkin holding clamp 10 by the clip arm 60. The clip arm distal end 70 is inserted in the upward facing horizontal seam 85 as found on a neck tie tied in the Windsor style. The napkin holding clamp 10 is then slidably moved downwardly to permit the clip arm hilt 78 to rest upon the horizontal segment 86 of the neck tie, at the top and center of the Windsor knot (to cite but a single example).

The collar or tie fabric (or the fabric proximate button hole 74) is preferably securely grasped by the spring tension of clip arm 60 which preferably bears light, steady pressure against base 12, between first and second elongate salients 32, 34. The fabric thus secured by clip arm 60 bears against the inner surfaces of salients 32, 34 and against the substantially planar surface of base 12 therebetween; friction force is also provided by the surface of clip arm 60. The surfaces of salients 32, 34, the trough or planar area of the base therebetween and the inward facing surface of clip arm 60 may all textured or serrated to further enhance the grasping and holding power of the spring clip 18 on the fabric so engaged. Alternatively, the resilient clip arm may be aligned substantially parallel to base back side 31 but not contact the back side, leaving a space between the clip arm 60 and the back side 31 proximate the clip arm distal end 70.

The napkin holding clamp 10 as shown in FIGS. 1, 2, 3 and 4 are drawn substantially to scale. Base 12 is approximately thirty mm along the long dimension and is approximately nineteen mm across the transverse, shorter width dimension; each of the elongate salient features 32, 34 is approximately seventeen mm in length. The planar front cover 50 of lever or actuator 16 is approximately twenty-eight mm along the long dimension and at its widest, is approximately twenty-two mm across the transverse, shorter width dimension. Clip arm 60 has a length measured from hilt 78 to distal end 70 of approximately thirty mm, and a transverse width, proximate the hilt 78 of approximately three mm; the clip arm width is compared to the relaxed width of a button hole (e.g., 74, once used) of approximately two to three mm; thus in the width dimension, a clip arm is unlikely to strain or tear open a button hole.

Alternatively, the clip arm can be integrally molded into and carried by the base 12 extending along substantially the entirety of the long dimension of and preferably bisecting base back side 31, between and parallel to elongated salient features 32, 34.

Figure 10:
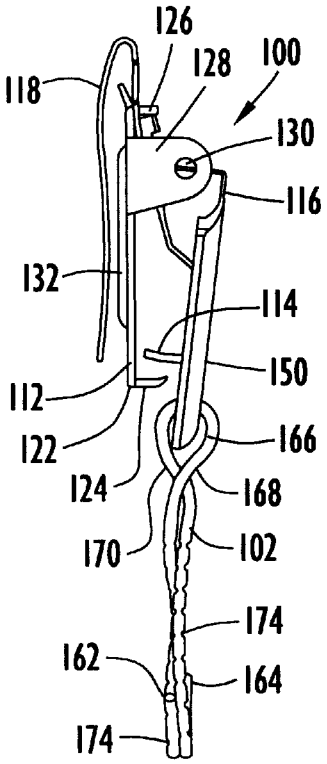
FIG. 10 shows, in elevation, a side view of the multi-purpose clamp of FIG. 9.
Figure 11:
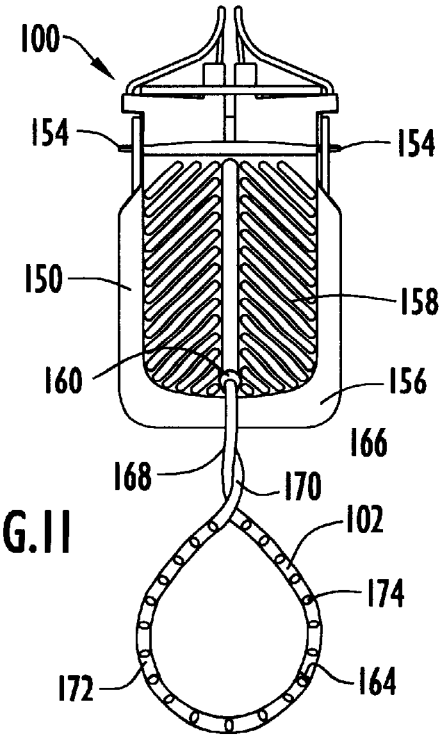
FIG. 11 shows, in elevation, a front view of the multi-purpose clamp of FIG. 9.

An alternative embodiment of the wearable clamp of the present invention is illustrated in FIGS. 9, 10 and 11. Wearable multi-purpose clamp 100 is illustrated in the closed position, supporting a user's eyeglasses 101 through a ring support 102; multipurpose clamp 100 is also well suited to grasp and hold a napkin (or other flexible substrate) as well as other articles, and so will, for purposes of nomenclature, be identified as a multi-purpose clamp. Multipurpose clamp 100 includes a substantially planar base 112 hingedly connected to a movable jaw 114 and carrying an actuator or L-shaped lever 116 and a spring clip 118. Base 112 includes a base jaw 122 having a plurality of jaw teeth or serrations 24 opposing (along the long dimension of base 112) a perpendicular base wall 126 (best seen in FIGS. 9 and 10). Base 112 includes a base central aperture proximate base wall 126 and has first and second opposing base projecting journals 128 which are preferably formed as perpendicular tabs, each including a journal hole 130. Base 112 also preferably includes first and second elongate salients 132 which are disposed substantially parallel to the base sidewalls and to one another and are spaced apart by a selected spacing, defining a trough, recess or groove therebetween. Movable jaw 114 also includes teeth or serrations adapted to cooperatively close in an offset shearing motion into close proximity with base jaw teeth 124. Movable jaw 114 also includes bendable, spring-like center tabs which are adapted to be received in a base central aperture, similarly to the embodiment of FIGS. 1–4. Movable jaw 114 also includes first and second side tabs which are disposed in a notch defined between the upwardly projecting base wall 126 and base projecting journals 128 to provide a spring biasing force (in cooperation with a biasing force provided by the center tabs) tending to force movable jaw 114 into the opened position. Movable jaw 114 also includes a camming surface disposed substantially between the base projecting journals 128.

L-shaped lever 16 includes a substantially planar front cover 150 attached at one end to a substantially perpendicular camming lever arm having, on opposite sides, first and second axial tabs 154 which are sized appropriately to be received in the coaxially aligned base projecting journal holes 130, as shown in FIGS. 9, 10 and 11, thereby defining a hinge having an axis of rotation. The lever planar front cover 150 has an outer surface 156 (as shown in FIG. 11) bearing an ornamental design 158 which is preferably stamped or molded into planar front cover 150. Optionally, a placard may be bonded onto outer surface for display of any selected symbols, indicia or logo.

The L-shaped lever front cover 116 includes a substantially planar front cover 150 with an aperture 160 therethrough for carrying integral ring support 102. The ring support 102 is preferably fabricated from spring steel and comprises a contiguous curved loop passing through the front cover aperture 160 and hanging loosely therefrom. The ring support 102 has first and second chamfered free ends 162,164 biased into overlapping contact and forming or defining an open loop opening when pried apart (e.g., as to insert a key having a key-ring aperture therethrough). The ring support 102 is preferably curved into an upper half circle section 166 of a smaller radius disposed in a first plane and passing through the front cover aperture 160 at a right angle thereto; the upper half circle section 166 is connected via first and second contiguous bent sections 168, 170 with a lower larger ring section 172 having a radius approximately three times the size of the upper half circle section 166 radius. The lower ring section 172 is disposed in a plane transverse to the plane of the upper half circle section 166 and is preferably indented with notches 174 on the front and back exterior surfaces.

In using multi-purpose clamp 100, a wearer or user may pry open first and second ends 162, 162 of ring support 102 and insert one or more keys into one end of the ring support, allowing the ends to snap together thereafter. The keys, thus supported, may be attached to the wearers person by either hanging the clamp from the spring clip 118 (as discussed above for the napkin holding clamp) or may clamp the multi-purpose clamp jaws 114, 122 to the clothing, for convenient safekeeping. As shown in FIG. 9, the user may also hang the clamp upon his or her person by the spring clip 118 and use the ring support to support a pair of eyeglasses 101 by one of the temple pieces; the user inserts the eyeglasses earpiece through the loop defined by ring support larger section 172, and slides the entire temple piece through the loop until the eyeglasses hang from ring support 102 by the hinge joining the eyeglasses temple piece to the frame.

Figure 12:
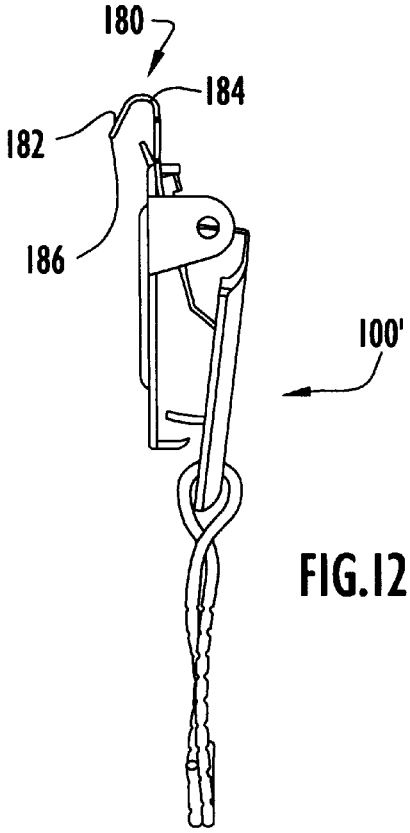
FIG. 12 shows, in elevation, a side view of an alternative embodiment of the multipurpose clamp.
Figure 13:
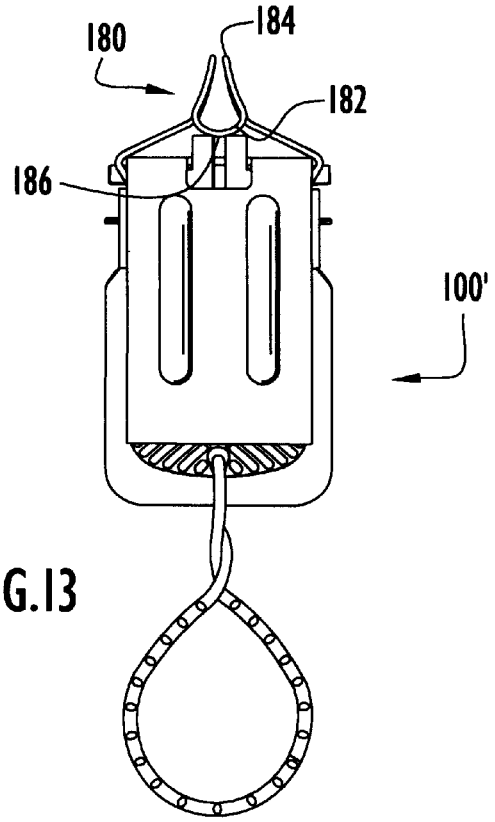
FIG. 13 shows, in elevation, a rear view of the multipurpose clamp of FIG. 12.

In an alternative embodiment, the clip arm is relatively shorter, extending from an upper apex downwardly toward the clamp back for a clamp arm length of approximately one centimeter. FIG. 12 shows, in elevation, a side view of an alternative embodiment of the multipurpose clamp and FIG. 13 shows, in elevation, a rear view of the multipurpose clamp of FIG. 12. In the embodiment of FIGS. 12 ans 13, a multi-purpose clamp 100' includes a spring clip 180 having a clip arm 182 with a length measured from hilt 184 to distal end 186 of approximately ten to twelve millimeters (mm) and a transverse width, proximate the hilt 184 of approximately three mm; the clip arm width is compared to the relaxed width of a button hole (e.g., 74, once used) of approximately two to three mm; thus in the width dimension, clip arm 182 is unlikely to strain or tear open a button hole.

In as much as the present invention is subject to various modifications and changes in detail, the above description of a preferred embodiment is intended to be exemplary only and not limiting. It is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A multi-purpose, wearable clamp for grasping and holding a flexible substrate, comprising:

a base having a front side, a back side and a first jaw disposed on said front side;

a second jaw, substantially opposable to said first jaw and hingedly carried on said base front side;

an actuator bearing upon said second jaw, and supported by said base;

a spring clip affixed to said base back side and having an elongate clip arm resiliently biased toward said base back side; and a support ring carried by said actuator and defining an open loop.

2. The clamp of claim 1, wherein said second jaw is biased apart from said first jaw.

3. The clamp of claim 1, wherein said spring clip comprises a contiguous length of wire forming a resiliently biased clip arm.

4. The clamp of claim 1, wherein said base back side includes at least one salient feature.

5. The clamp of claim 4, wherein said clip arm is biased into a position proximate said salient feature.

6. The clamp of claim 1, further including a front cover bearing a design, logo or indicia.

7. The clamp of claim 6, further including a napkin or scarf bearing indicia matching the indicia on said front cover.

8. A clamp for grasping and holding a napkin or other flexible substrate, comprising:

a base having a back side, first and second projecting journals with coaxially aligned holes therethrough, and a first jaw;

a second jaw, substantially opposable to and biased apart from said first jaw;

a lever including a front cover, axial members received in said journal holes, and a lever arm oriented to bear against said second jaw;

a spring clip having a clip arm resiliently biased toward said base back side; and a ring support defining an open loop, said ring support carried upon said front cover.

9. The clamp of claim 8, wherein said base back side includes at least one salient feature.

10. The clamp of claim 9, wherein said clip arm is biased into a position proximate said salient feature.

11. The clamp of claim 8, further including a front cover bearing a design, logo or indicia.

12. The clamp of claim 11, further including a napkin or scarf bearing indicia matching the indicia on said front cover.

13. A method for wearing and supporting a pair of eyeglasses having a temple piece terminated in an ear piece and connected to a frame via a hinge, comprising the method steps of:

a) providing a wearable multi-purpose clamp including a base having a back side and a first jaw, a second jaw, substantially opposable to and biased apart from said first jaw, a spring clip having a clip arm and a ring support defining an open loop;

b) grasping a garment to expose a button hole;

c) inserting the clip arm into said button hole; and d) inserting the eyeglasses ear piece into and through the ring support open loop.

14. The method of claim 13, wherein method step d includes:

d1) moving the temple piece of the eyeglasses through the open loop and up to the temple hinge.

* * * * *